US009814927B2

(12) United States Patent
Forystek

(10) Patent No.: US 9,814,927 B2
(45) Date of Patent: Nov. 14, 2017

(54) ABDOMINAL EXERCISE APPARATUS

(71) Applicant: Leon Forystek, Rossford, OH (US)

(72) Inventor: Leon Forystek, Rossford, OH (US)

( * ) Notice: Subject to any disclaimer, the term of this patent is extended or adjusted under 35 U.S.C. 154(b) by 0 days.

(21) Appl. No.: 15/054,846

(22) Filed: Feb. 26, 2016

(65) Prior Publication Data

US 2017/0246498 A1 Aug. 31, 2017

(51) Int. Cl.

| | |
|---|---|
| ***A63B 22/20*** | (2006.01) |
| ***A63B 21/00*** | (2006.01) |
| ***A63B 21/02*** | (2006.01) |
| ***A63B 21/055*** | (2006.01) |
| ***A63B 23/02*** | (2006.01) |

(52) U.S. Cl.

CPC ..... *A63B 21/4045* (2015.10); *A63B 21/023* (2013.01); *A63B 21/055* (2013.01); *A63B 21/0557* (2013.01); *A63B 21/154* (2013.01); *A63B 21/4034* (2015.10); *A63B 21/4035* (2015.10); *A63B 23/0205* (2013.01); *A63B 23/0211* (2013.01)

(58) Field of Classification Search

CPC ..... A63B 21/4045; A63B 21/4035; A63B 21/4034; A63B 21/0557; A63B 21/055; A63B 21/154; A63B 21/00189; A63B 21/02; A63B 21/025; A63B 21/0407; A63B 21/0421; A63B 21/0428; A63B 21/0442; A63B 21/409; A63B 21/4039; A63B 23/0211; A63B 23/0205; A63B 23/023; A63B 2023/003; A63B 2023/006

See application file for complete search history.

(56) References Cited

U.S. PATENT DOCUMENTS

| | | | |
|---|---|---|---|
| 1,984,165 | A | 12/1934 | Tolchin |
| 2,131,570 | A | 9/1938 | Riley |
| 2,920,418 | A | 1/1960 | Britt |
| 3,403,906 | A | 10/1968 | Burzenski |
| 3,572,701 | A | 3/1971 | Agamian |
| 3,589,720 | A | 6/1971 | Agamian |
| 3,752,475 | A | 8/1973 | Ott |
| 4,171,805 | A | 10/1979 | Abbott |
| 4,620,704 | A | 11/1986 | Shifferaw |
| 4,930,769 | A | 6/1990 | Nenoff |
| 5,447,483 | A | 9/1995 | Liang |
| 5,499,961 | A | 3/1996 | Mattox |

(Continued)

FOREIGN PATENT DOCUMENTS

EP 2425880 A1 3/2012

*Primary Examiner* — Loan H Thanh
*Assistant Examiner* — Megan Anderson

(57) ABSTRACT

An abdominal exercise apparatus can include a track, at least one rolling member, a cart, and a base. The track can extend between first and second ends. The rolling member can be moveable along the track. The cart can support the rolling member for the movement along the track and be grasped by the user during exercise. The base can be engaged proximate to the first end and have a surface configured to receive the knees of the user during exercise. The second end can be pivotally movable about the base over an arcuate range by the user while exercising during the rectilinear and rolling movement along the track by the at least one rolling member. The apparatus can also include a structure such as a helical spring for resisting pivotal movement that is elastically deformable.

34 Claims, 7 Drawing Sheets

(56) References Cited

U.S. PATENT DOCUMENTS

| | | | | |
|---|---|---|---|---|
| 5,518,483 | A | 5/1996 | Oswald | |
| 6,017,296 | A | 1/2000 | Tang et al. | |
| D425,585 | S | 5/2000 | Wu | |
| 6,071,217 | A | 6/2000 | Barnett | |
| 6,196,954 | B1 | 3/2001 | Chen | |
| 6,203,476 | B1 | 3/2001 | Wang et al. | |
| 6,254,518 | B1 | 7/2001 | Yu | |
| 6,338,703 | B1 | 1/2002 | Yu | |
| 6,348,027 | B1 | 2/2002 | Lee | |
| 6,354,983 | B1 | 3/2002 | Lee | |
| 6,409,639 | B1 | 6/2002 | Kuo | |
| 6,440,045 | B1 | 8/2002 | Gaston | |
| 6,544,153 | B2 | 4/2003 | Lee | |
| 6,629,913 | B2 | 10/2003 | Chen | |
| 6,746,383 | B2 | 6/2004 | Yu | |
| 7,004,894 | B1 * | 2/2006 | Trotter | A63B 23/02 482/140 |
| 7,232,404 | B2 | 6/2007 | Nelson | |
| 7,455,633 | B2 | 11/2008 | Brown et al. | |
| 7,485,079 | B2 | 2/2009 | Brown et al. | |
| 7,585,263 | B2 | 9/2009 | Brown et al. | |
| 7,951,052 | B1 | 5/2011 | Tang | |
| 8,137,251 | B2 | 3/2012 | Tozzi | |
| 8,241,186 | B2 | 8/2012 | Brodess et al. | |
| 8,708,874 | B2 | 4/2014 | Chen | |
| 9,005,089 | B2 | 4/2015 | Huang | |
| 9,186,544 | B1 * | 11/2015 | Kastrat | A63B 21/025 |
| 2003/0022770 | A1 | 1/2003 | Lee | |
| 2011/0118088 | A1 | 5/2011 | Caya et al. | |
| 2012/0108405 | A1 | 5/2012 | Milo | |
| 2012/0225759 | A1 | 9/2012 | Tsai | |
| 2013/0065736 | A1 | 3/2013 | Chen | |
| 2017/0014667 | A1 * | 1/2017 | Barnett | A63B 21/4031 |

* cited by examiner

ABDOMINAL EXERCISE APPARATUS

BACKGROUND

1. Field

The present disclosure relates to an abdominal exercise apparatus.

2. Description of Related Prior Art

U.S. Pat. No. 8,241,186 discloses INTERACTIVE EXERCISE DEVICES. An interactive exercise device includes a stationary base to which a first exercise implement is movably connected. A first resistance element is operably connected to the first exercise implement to provide resistance against at least some movements of the first exercise implement relative to the stationary base. An interactive motion guide that directs a user of the interactive exercise device to move the first exercise implement relative to the stationary base in an indicated manner is operably connected to the interactive exercise device. The interactive motion guide includes first and second electronic indicators to which a processor is operably connected. A non-transitory and tangible computer readable medium is operably connected to the processor and includes instructions to manipulate output of the first and second electronic indicators in response to movement of the first exercise implement relative to the stationary base.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

An abdominal exercise apparatus can include a track, at least one rolling member, a cart, and a base. The track can extend a length between a first end and a second end. The at least one rolling member can be rectilinearly moveable along the track between the first end and the second end by a user during exercise. The cart can support the at least one rolling member for the rectilinear and rolling movement along the track and can have a portion configured to be grasped by the user during exercise. The base can be engaged with the track proximate to the first end and have at least one surface configured to receive first and second knees of the user during exercise. The second end can be pivotally movable about the base over an arcuate range by the user while exercising during the rectilinear and rolling movement along the track by the at least one rolling member. The abdominal exercise apparatus can also include means for resisting pivotal movement that is elastically deformable during movement over the arcuate range.

BRIEF DESCRIPTION OF THE DRAWINGS

The detailed description set forth below references the following drawings.

DETAILED DESCRIPTION

Figure 1:
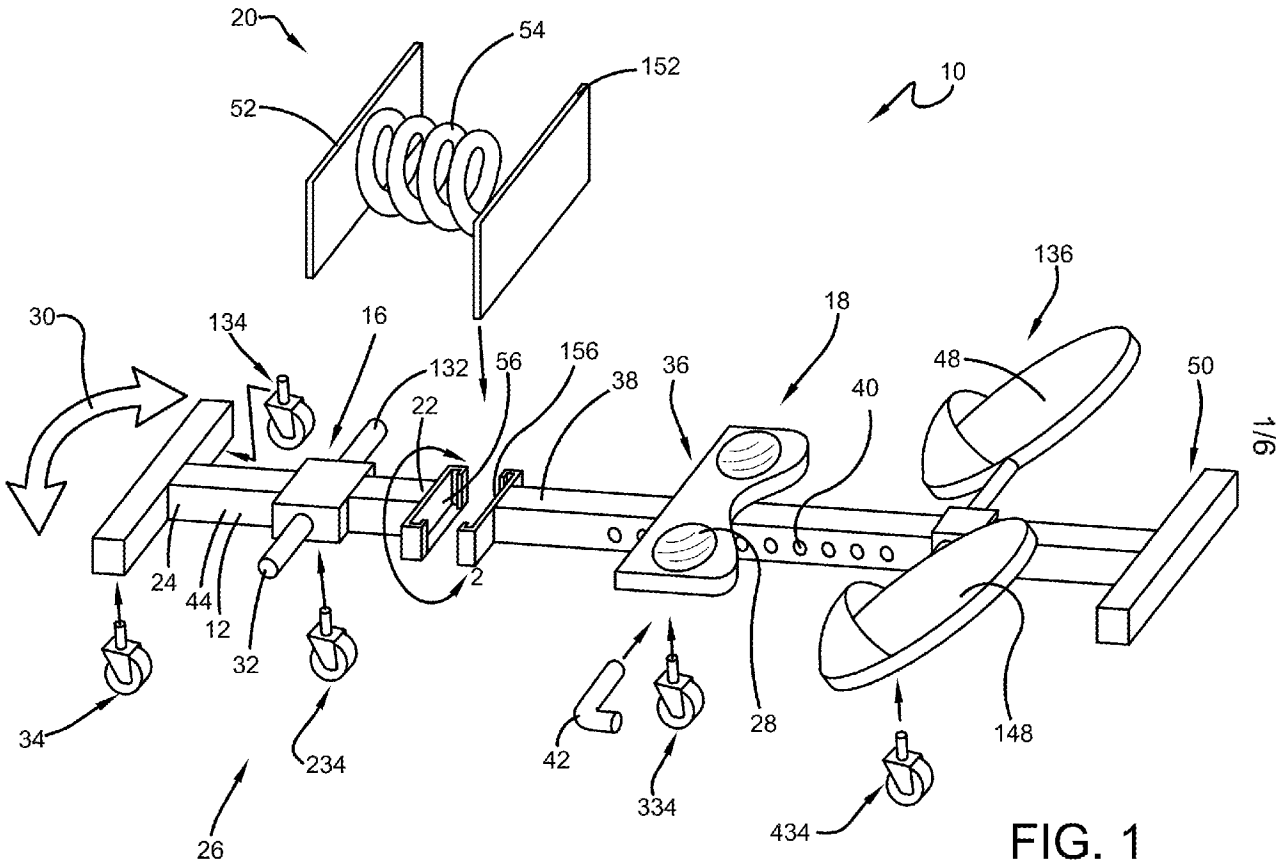
FIG. 1 is a perspective view of an abdominal exercise apparatus according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

In a first exemplary embodiment of the present disclosure, as shown in FIG. 1, an abdominal exercise apparatus 10 can include a track 12, at least one rolling member, a cart 16, and a base 18. The track 12 can extend a length between a first end 22 and a second end 24. The at least one rolling member in the first exemplary embodiment is embedded in the cart 16 and not visible. The rolling member can be rectilinearly moveable along the track 12 between the first end 22 and the second end 24 by a user during exercise. The cart 16 can support the at least one rolling member for the rectilinear and rolling movement along the track 12 and can have a portion 26 configured to be grasped by the user during exercise. The exemplary portion 26 can include first and second handles 32, 132. The base 18 can be engaged with the track 12 proximate to the first end 22 and have at least one surface 28 configured to receive first and second knees of the user during exercise. The second end 24 can be pivotally movable about the base 18 over an arcuate range 30 by the user while exercising during the rectilinear and rolling movement along the track 12 by the at least one rolling member 14. The user can concurrently move the cart 16 from the first end 22 to the second end 24 while moving the second end 24 along the arcuate range 30. The abdominal exercise apparatus 10 can also include means 20 for resisting pivotal movement along the arcuate range 30 that is elastically deformable during movement over the arcuate range 30. It is noted that means 20 is shown magnified or enlarged relative to the other structures of the apparatus 10 in FIG. 1.

The exemplary track 12 is shown as having a rectangular cross-section. However, a track in an implementation of the present disclosure can take other forms. For example, the track can have a channel profile, a cylindrical outer surface, or some other shape.

The rolling member is not visible in FIG. 1, but can take several different forms. By way of example and not limitation, the rolling member can be a wheel, a cylindrical bearing, or a spherical bearing. Embodiments of the present disclosure can have multiple rolling members respectively positioned in multiple planes to inhibit binding.

The rolling member is rectilinearly moveable along the track 12 in that instantaneous movement of the rolling member relative to the track is rectilinear. The rolling member can be rotating along the track, but the center of rotation of the rolling member is moving rectilinearly along the track.

The exemplary track 12 can be T-shaped, with longitudinal portion 44 and a transverse portion 46. The track 12 be supported on casters, such as casters 34, 134. The cart 16 can also be supported on one or more casters, such as caster 234. Additional structures can be mounted on the track 12, such as at the distal ends of the transverse portion 46. For example, handle bars for doing push-ups can be mounted at the distal ends of the transverse portion 46.

The exemplary base 18 can include a cart 36 and a rail 38. The cart 36 can define the surface 28 and be moveable along the rail 38. The cart 36 can be supported on casters, such as caster 334. The rail 38 can define a plurality of apertures, such as aperture 40, and the cart 36 can be selectively locked into a particular position along the rail 38 by inserting a pin 42 through an aperture in the cart 36 and in one of the apertures in the rail 38.

The exemplary base 18 can also include a cart 136. The cart 136 can define pockets 48, 148 and be moveable along the rail 38. The cart 136 can be supported on casters, such as caster 434. The cart 136 can be selectively locked into a particular position along the rail 38 by inserting a pin, such as pin 42 or a similar pin, through an aperture in the cart 136 and in one of the apertures in the rail 38. The pockets 48, 148 can receive a user's feet.

The at least one surface 28 can be defined by a single surface that receives both of the user's knees or by a plurality of surfaces that are each configured to receive one of the user's knees. The surface 28 can support forward faces of the knees or sides of the knees.

A transverse member 50 can be positioned at an end of the base 18. The transverse member 50 can be fixedly or releasably engaged with the rail 38. The transverse member 50 can be encased in rubber or an elastomer. During exercise, the transverse member 50 can provide inhibit movement of the apparatus relative to the floor.

Figure 2:
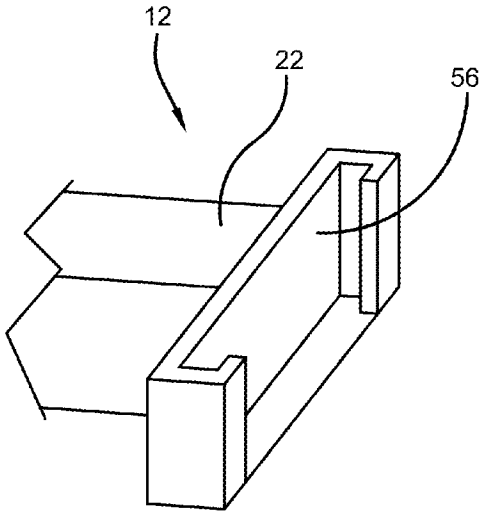
FIG. 2 is a magnified portion of FIG. 1.

Means 20 for resisting pivotal movement can define the strongest structural interconnection between the track 12 and the base 18 that prevents separation of the track 12 and the base 18. In the first exemplary embodiment, means 20 can include a pair of plates 52, 152 and a helical spring 54. The first end 22 of the track 12 can define a pocket 56. The pocket 56 is best shown in FIG. 2. The plate 52 can slide into and be retained by the pocket 56. The base 18 can include a similar pocket 156 and receive the plate 152. In the first exemplary embodiment of the present disclosure, the means 20 for resisting pivotal movement is the only structural interconnection between the track 12 and the base 18.

Means 20 allows the second end 24 to be pivotally movable about the base 18 by the user during exercise during the rectilinear and rolling movement along the track 12 by the at least one rolling member. The spring 54 is bendable by a human user during movement of the at least one rolling member and cart 16 along the track 12. The spring 54 is elastically deformable during the rectilinear and rolling movement of the cart 16 along the track 12. The spring 54 can also be deformed when the cart 16 is maintained at a fixed position along the track 12; the user can contract his/her oblique muscles to induce bending of the spring 54 while keeping the cart 16 at a fixed position between the first and second ends 22, 24.

The means 20 between the base 18 and the track 12 is such that the user is not required to plastically deform or fracture the track 12, the base 18, or the means 20 to pivot the second end 24 about the base 18. The typical maximum stack weight for a rotary abdominal machine is two hundred and fifty pounds, so the spring 54 can be configured to resist bending by two hundred and fifty pounds. Springs having other levels of resistance to bending can also be used in other embodiments of the present disclosure. In various embodiments of the present disclosure, the arcuate distance of the range 30 can be observable by a human, not de minimis or microscopic bending.

In one or more implementations of the present disclosure, means 20 can include a plurality of spring-plate structures. Each can take the form of a spring fixedly attached at opposite ends to two plates. The plates can be arranged to fit into pockets defined by the track 12 and the base 18. Each spring-plate structure can include a differently-sized spring. The strongest spring can be configured to resist bending by two hundred and fifty pounds. The other springs can define a range of different resistances to bending. Over time, the user can progressively increase the size/strength of the spring used during training. Each of the plurality of helical springs can be individually and selectively engageable with both of the track 12 and the base 18 and also be replaceable with each of the other of the plurality of helical springs.

In one exercise, the user can grasp the handles 32, 132, lock the cart 36, rest his/her knees on the cart 36 of the base 18, and move the cart 16 in back-and-forth rectilinear movement along the longitudinal portion 42 of the track 12 between the first and second ends 22, 24.

In another exercise, the user can grasp the handles 32, 132, lock the cart 36, rest his/her knees on the cart 36 of the base 18, and move the cart 16 in back-and-forth rectilinear movement along the longitudinal portion 42 of the track 12 between the first and second ends 22, 24 and also urge the second end 24 to pivot along the range 30 (bending the spring 54).

In another exercise, the user can grasp distal ends of the transverse portion, or handles mounted thereon, unlock the cart 36, and move the cart 36 in back-and-forth rectilinear movement along the rail 38.

In another exercise, the user can grasp the handles 32, 132, lock the cart 136, place his/her feet in the pockets 48, 148 of the cart 136 of the base 18, and move the cart 16 in back-and-forth rectilinear movement along the longitudinal portion 42 of the track 12.

Figure 3:
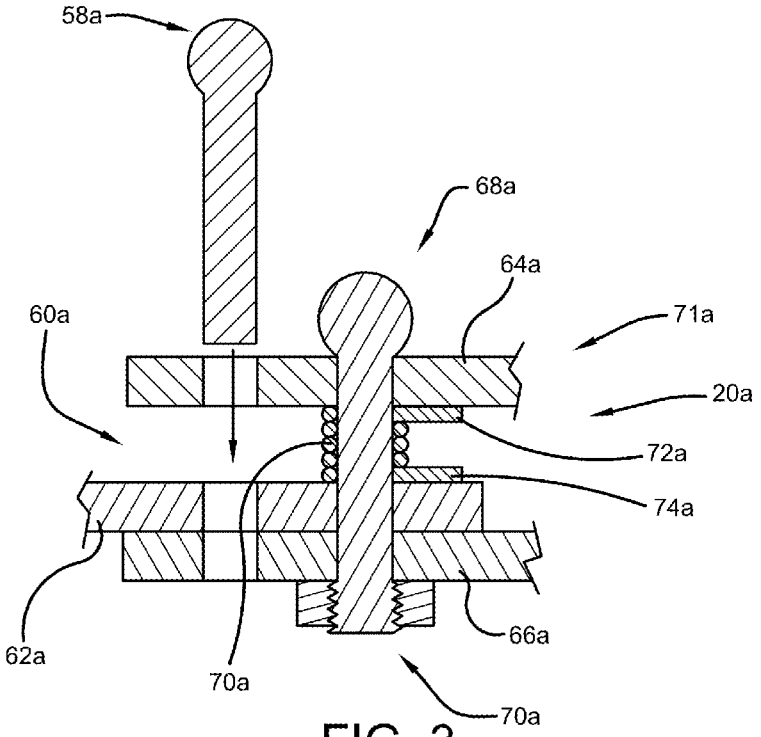
FIG. 3 is a cross-sectional view of a portion of an abdominal exercise apparatus according to an exemplary embodiment of the present disclosure.

U.S. Pat. No. 8,241,186 is hereby incorporated by reference. In a second exemplary embodiment of the present disclosure, an abdominal exercise apparatus can include a track such as "track 1" in the '186 patent, at least one rolling member such as "rollers 48" in the '186 patent, a cart such as "console 3" in the '186 patent, and a base such as "base 7" in the '186 patent. Referring now to FIG. 3, the second exemplary abdominal exercise apparatus can also include means 20*a* for resisting pivotal movement that is elastically deformable during movement over the arcuate range of movement of the second end of the track, such as "distal end 4" of the '186 patent.

In FIG. 3, the pin 58*a* is analogous to the "locking mechanism 23." The slit 60*a* is analogous to the "slit 29." The beam 62*a* is analogous to the "beam 9." The slit 60*a* is defined between first and second portions 64*a*, 66*a* of the base. The beam 62*a* is received in the slit 60*a*. A pin 68*a* defines the pivot axis of the beam 62*a* relative to the base (this structure is not numbered in the '186 patent). The pin 68*a* thus defines part of a hinge assembly 71*a* interconnecting the track and the base.

Means 20*a* comprises at least one torsion spring 70*a* encircling the hinge pin 68*a*. A first end 72*a* of the torsion spring 70*a* can be fixed to one of the portions 64*a*, 66*a* and a second end 74*a* of the torsion spring 70*a* can be fixed to the beam 62*a*. The ends 72*a*, 74*a* can be held by clips or received in notches or apertures in order for the torsion spring 70*a* to be replaceable. When the beam 62*a* is urged from an orientation that is perpendicular to the base, the torsion spring 70*a* can be elastically deformed and resist the movement. Means 20*a* for resisting pivotal movement is thus structurally disposed between the track and the base in parallel to the hinge assembly 70*a*. In parallel refers to the fact that means 20*a* is engaged with the track and the base but does not provide a structural interconnection. The exemplary engagement is physical contact and concurrent movement.

In one or more implementations of the present disclosure, means 20*a* can include a plurality of torsion springs. Each torsion spring can be differently-sized, and provide different levels of resistance to deformation. Over time, the user can progressively increase the size/strength of the spring used during training. Each of the plurality of torsion springs can be individually and selectively engageable with both of the track and the base and also be replaceable with each of the other of the plurality of torsion springs.

Figure 4:
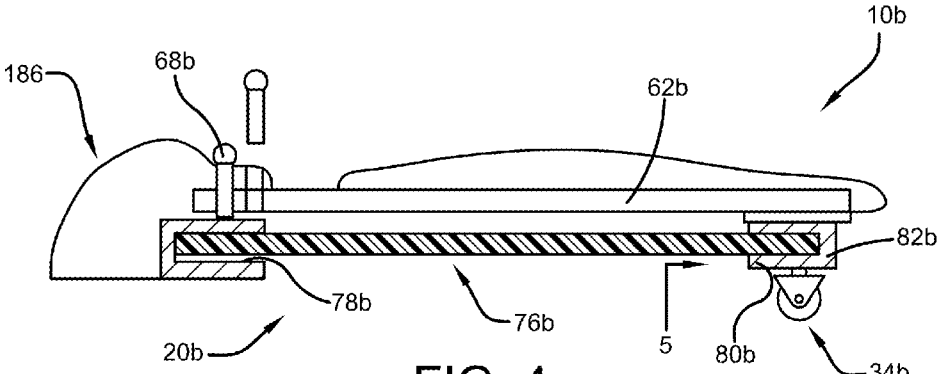
FIG. 4 is a side and partial cross-sectional view of an abdominal exercise apparatus according to an exemplary embodiment of the present disclosure.

As shown in FIG. 4, in a third exemplary embodiment of the present disclosure, an abdominal exercise apparatus 10*b* can include a track such as "track 1" in the '186 patent, at least one rolling member such as "rollers 48" in the '186 patent, a cart such as "console 3" in the '186 patent, and a base such as "base 7" in the '186 patent. The second exemplary abdominal exercise apparatus can also include means 20*b* for resisting pivotal movement that is elastically deformable during movement over the arcuate range of movement of the second end of the track, such as "distal end 4" of the '186 patent.

In FIG. 4, the base 18*b* is analogous to the "base 7." The beam 62*b* is analogous to the "beam 9." A pin 68*b* defines the pivot axis of the beam 62*b* relative to the base 18*b*. A caster 34*b* is analogous to the "wheel 62."

Figure 5:
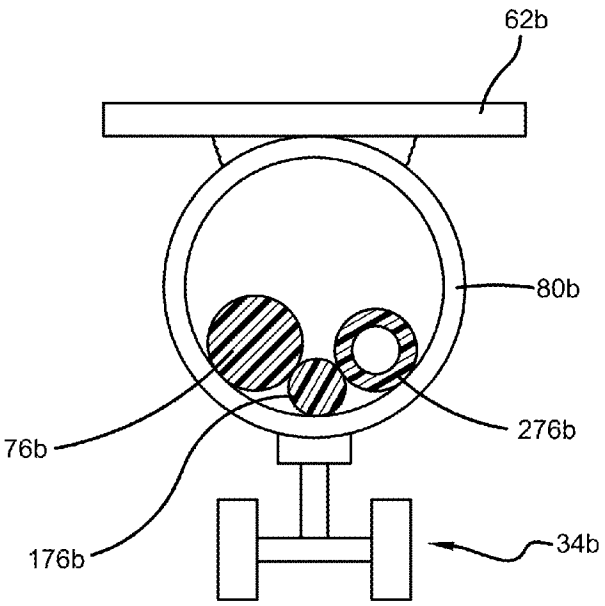
FIG. 5 is view taken from perspective line 5 in FIG. 4 of a portion of an abdominal exercise apparatus according to an exemplary embodiment of the present disclosure.

Means 20*b* for resisting pivotal movement is at least one rod 76*b*. The rod 76*b* can be formed with carbon fiber, plastics such as nylon, or composites of various materials. One end of the rod 76*b* can be captured in a pocket 78*b* associated with the base 18*b* and a sleeve 80*b* associated with the distal end of the beam 62*b*. One end of the sleeve 80*b* can be selectively closed with a cap 82*b*. The sleeve 80*b* and cap 82*b* can be threadingly engaged with one another, allowing one or more rods to be selectively used. A plurality of rods can be engageable with the track and the base 18*b* individually and in groups of two or more. FIG. 5 shows a plurality of rods 76*b*, 176*b*, 276*b* disposed in the sleeve 80*b* for bending during exercise by a user. The rods 76*b*, 176*b*, 276*b* can have different outside diameters, can be solid or hollow, and hollow rods can have different wall thicknesses to provide different resistances to bending.

Figure 7:
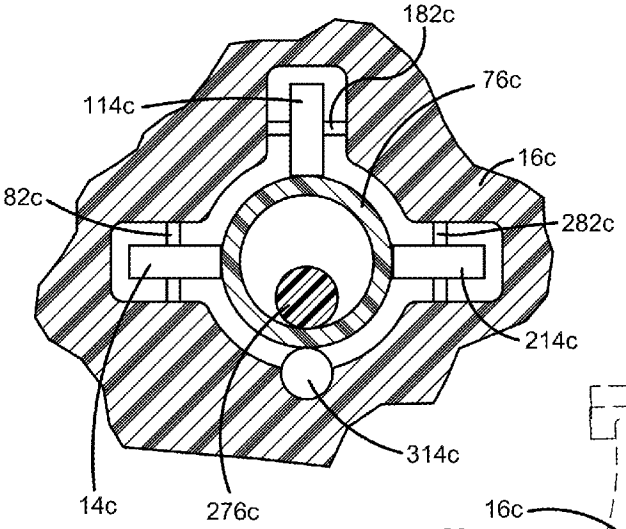
FIG. 7 is a cross-sectional view taken along section lines 7-7 in FIG. 6.
Figure 6:
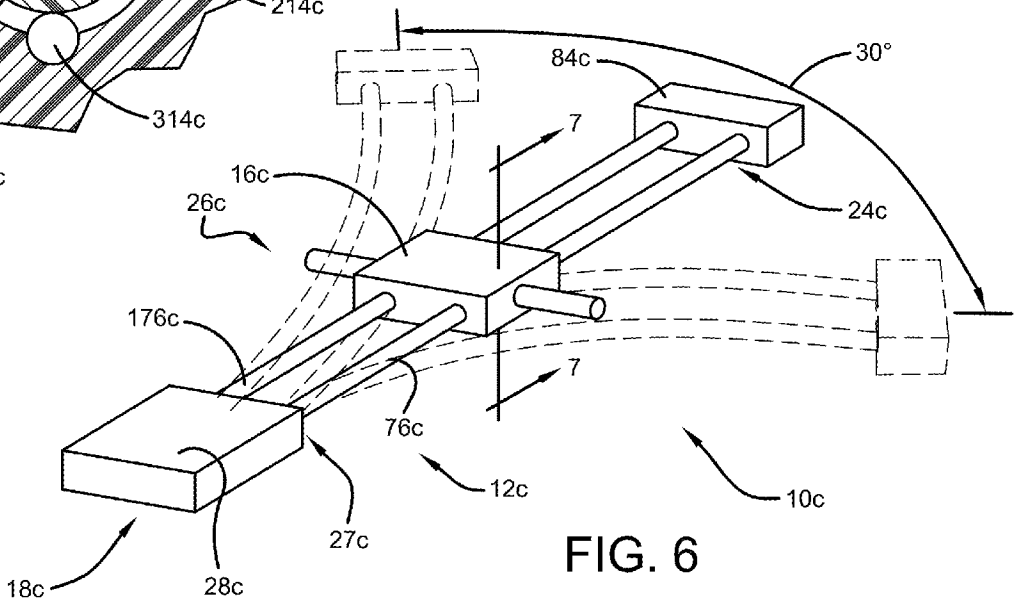
FIG. 6 is a perspective view of an abdominal exercise apparatus according to an exemplary embodiment of the present disclosure.

In a fourth exemplary embodiment of the present disclosure, as shown in FIGS. 6 and 7, an abdominal exercise apparatus 10*c* can include a track 12*c*, at least one rolling member 14*c*, a cart 16*c*, and a base 18*c*. The track 12*c* can extend a length between a first end 22*c* and a second end 24*c*. The track 12*c* is defined by rods 76*c*, 176*c*. The at least one rolling member 14*c* can be rectilinearly moveable along the track 12*c* between the first end 22*c* and the second end 24*c* by a user during exercise. The exemplary rolling member 14*c* is one a plurality of rolling members 14*c*, 114*c*, 214*c* each having a respective rolling axis 82*c*, 182*c*, 282*c* about which the respective rolling movement occurs. The rolling axes 82*c* and 182*c* are transverse to one another. The rolling axes 182*c* and 282*c* are transverse to one another. The rolling axes 82*c* and 282*c* are parallel to one another. The rolling members 82*c*, 182*c*, 282*c* can be wheels or cylindrical bearings. A rolling member 314*c* can be a spherical bearing.

The cart 16*c* can support the at least one rolling member 14*c* for the rectilinear and rolling movement along the track 12*c* and can have a portion 26*c* configured to be grasped by the user during exercise. The base 18*c* can be engaged with the track 12*c* at the first end 22*c* and have at least one surface 28*c* configured to receive first and second knees of the user during exercise. The second end 24*c* can be pivotally movable about the base 18*c* over an arcuate range 30*c* by the user while exercising during the rectilinear and rolling movement along the track 12*c* by the at least one rolling member 14*c*. The abdominal exercise apparatus 10*c* can also include means 20*c* for resisting pivotal movement that is elastically deformable during movement over the arcuate range 30*c*.

Means 20*c* for resisting pivotal movement is further defined as integrally-formed with the track 12*c*. The track 12*c* is defined by rods 76*c*, 176*c* and the rods 76*c*, 176*c* are elastically deformable during exercise, as shown in phantom in FIG. 6. "Integrally-formed" refers to things that are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined. In other implementations of the present disclosure, means for resisting pivotal movement can be integrally-formed with the base.

The rods 76*c* and 176*c* can be received in apertures in the base 18*c* (not visible) and capped by being received in apertures in an end member 84*c*. A plurality of rods can be engageable with the rods 76*c*, 176*c* that define the track 12*c*, individually and in groups of two or more. FIG. 7 shows that one or more rods can be disposed within other rods. A rod 276*c* can be positioned in the rod 76*c*. The exemplary rod 276*c* is solid (non-hollow), but hollow rods can be received in either rod 76*c* or 176*c* so that more than one rod can be received in each. It is noted also that more than one rod can be placed side-by-side in one of the rods 76*c*, 176*c*. The various rods can have can have different outside diameters and different thicknesses to provide different levels of resistance to bending.

Figure 8:
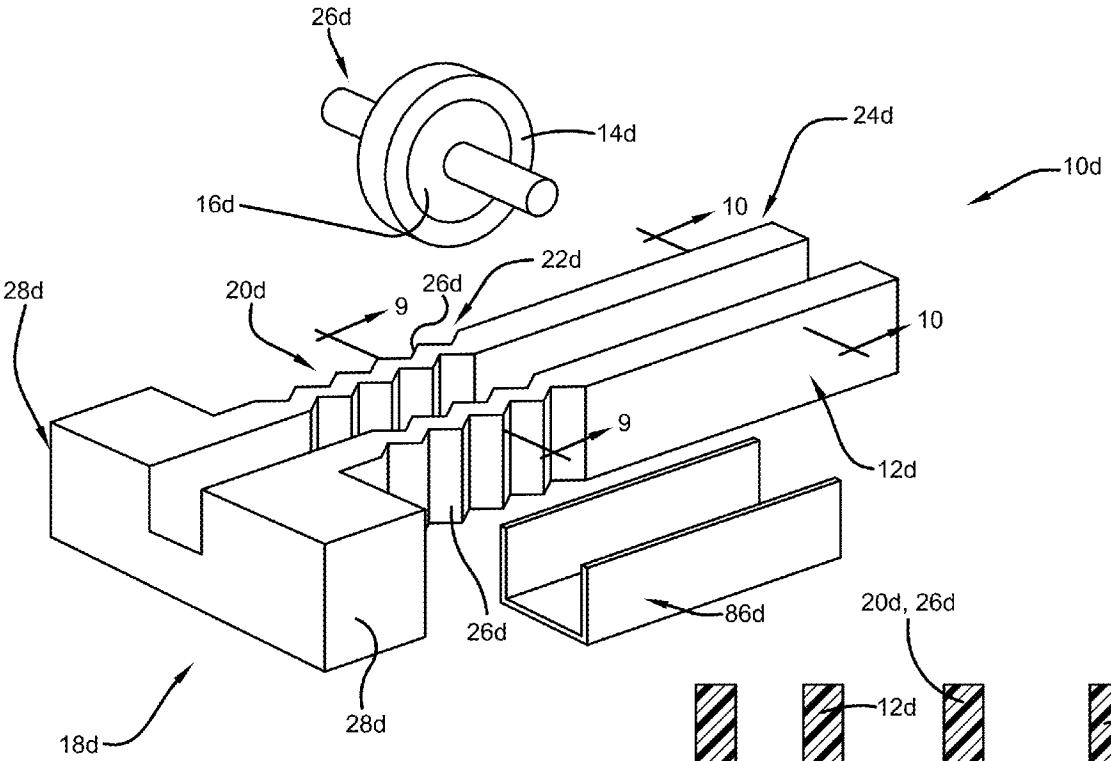
FIG. 8 is a perspective view of an abdominal exercise apparatus according to an exemplary embodiment of the present disclosure.
Figure 9:
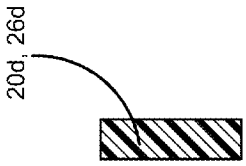
FIG. 9 is a cross-sectional view taken along section lines 9-9 in FIG. 8.

In a fifth exemplary embodiment of the present disclosure, as shown in FIGS. 8 and 9, an abdominal exercise apparatus 10*d* can include a track 12*d*, at least one rolling member 14*d*, a cart 16*d*, and a base 18*d*. The track 12*d* can extend a length between a first end 22*d* and a second end 24*d*. The at least one rolling member 14*d* can be rectilinearly moveable along the track 12*d* between the first end 22*d* and the second end 24*d* by a user during exercise. The cart 16*d* can support the at least one rolling member 14*d* for the rectilinear and rolling movement along the track 12*d* and can have a portion 26*d* configured to be grasped by the user during exercise. The base 18*d* can be engaged with the track 12*d* at the first end 22*d* and have at least one surface 28*d* configured to receive first and second knees of the user during exercise. The second end 24*d* can be pivotally movable about the base 18*d* over an arcuate range by the user while exercising during the rectilinear and rolling movement along the track 12*d* by the at least one rolling member 14*d*. The abdominal exercise apparatus 10*d* can also include means 20*d* for resisting pivotal movement that is elastically deformable during movement over the arcuate range.

Means 20*d* for resisting pivotal movement can be integrally-formed with the base 18*d* and the track 12*d*. The track 12*d*, base 18*d*, and means 20*d* can be integrally formed together. Means 20*d* can be a portion 26*d* of variable cross-section of the track 12*d*. The track 12*d*, base 18*d*, and means 20*d* can be formed with carbon fiber, plastics such as nylon, or composites of various materials.

Figure 10:
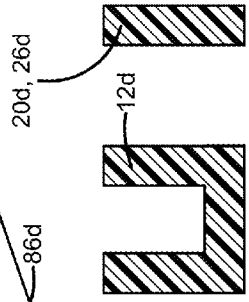
FIG. 10 is a cross-sectional view taken along section lines 10-10 in FIG. 8.

The cross-section of the structure at means 20*d* varies in that as cross-sections are taken along the apparatus 10*d* from the base 18*d* to the second end 24*d*, at least two cross-sections will have different shapes from one another. The portion of variable cross-section of the track 12*d* is further defined as a bellows. FIG. 9 shows a cross-section through the bellows. FIG. 10 shows a cross-section through the track 12*d* proximate to the second end 24*d*. The track 12*d* is generally channel-shaped, but the bottom of the channel is missing in the bellows portion to allow for pivoting of the second end 24*d* about the base 18*d*.

The fifth embodiment can also include a sleeve 86*d*. The sleeve 86*d* can be shaped to surround at least part of the portion 26*d* of variable cross-section as well as part of the track 12*d*. The sleeve 26*d* can be slidable along the length of the track 12*d* to overlap a selectable amount of the portion 26*d*. By overlapping part of the portion 26*d*, the sleeve 86*d* can limit the number of bellows that can be elastically deformed and thereby make pivoting movement more difficult. The bellows overlapped by the sleeve 86*d* are inhibited from elastically deforming. When none of the bellows are overlapped, each of the bellows can be elastically deformed generally the same amount over a particular arcuate range. As more bellows are overlapped, the bellows that are not overlapped by the sleeve 86*d* must elastically deform a greater amount when elastically deforming over the particular arcuate range.

Various embodiments of means for resisting pivotal movement have been disclosed. Means that are selectively variable have been disclosed. The first embodiment can include a plurality of different helical springs. The second embodiment can include a plurality of different torsional springs. The third embodiment can include a plurality of different rods, including rods of different sizes and thickness. The fourth embodiment can include a plurality of rods, including rods within other rods. The fifth embodiment can include a sleeve that can overlap a selectable number of bellows.

Various embodiments of means for resisting pivotal movement have been disclosed. Means that are fixedly variable have been disclosed. The second embodiment can include a torsional spring having a resistance to bending that varies over the extent of deformation. A torsion spring can be applied that increases in resistance over the arcuate range to match the distance that the cart is from the pivot axis. As the cart moves further from the pivot axis, the moment acting on the torsion increases. Therefore, a torsional spring can be utilized that prevents pivoting movement from becoming easier as the cart moves further from the pivot axis.

Figure 11:
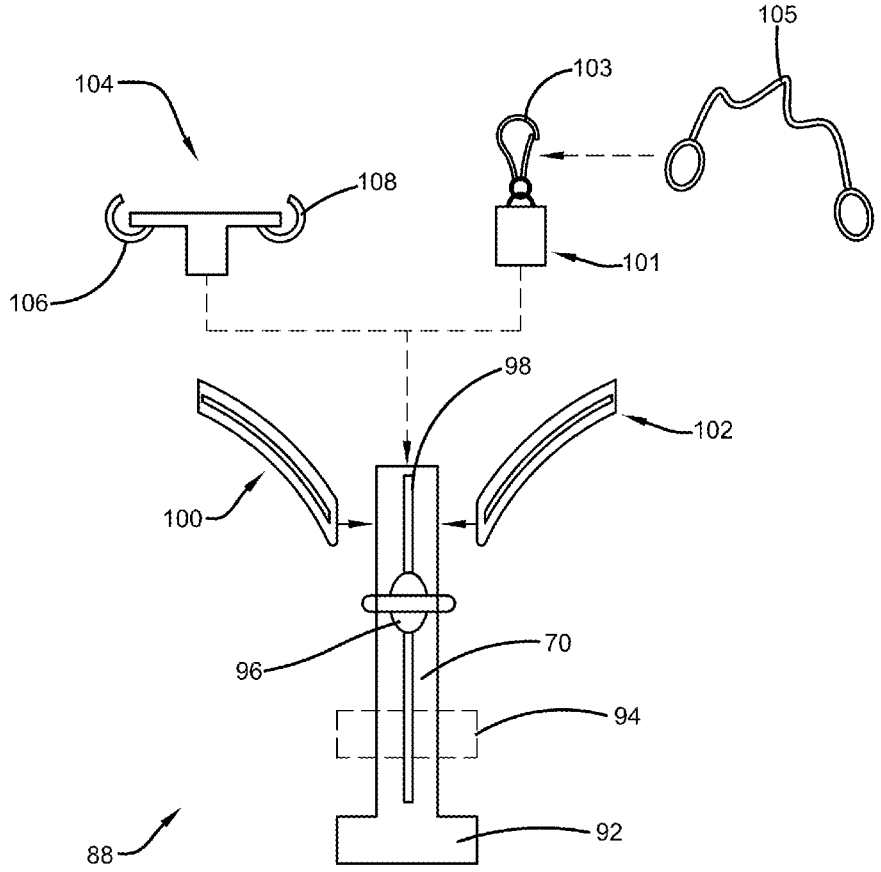
FIG. 11 is a top-down view of an abdominal exercise apparatus according to an exemplary embodiment of the present disclosure.
Figure 12:
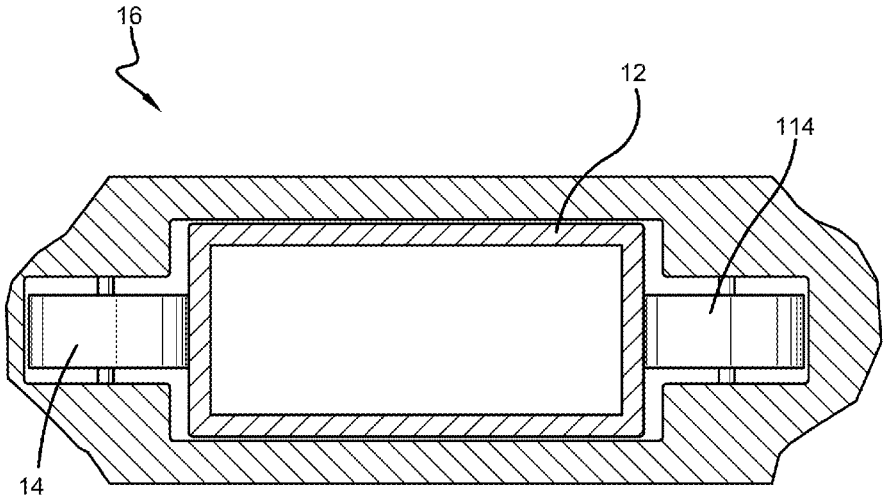

FIG. 11 illustrates another exercise system. An apparatus 88 can include a track 90 and a base 92. The exemplary base 92 can be fixed relative to the track 90, but the apparatus 88 could include a base 94 (shown in phantom) mounted for movement along the track 90. The apparatus 88 can also include a cart 96 for movement along the track 90. The track 90 can define a slot 98 for receiving part of the cart 96 and guiding the cart 96 in movement along the track 98.

The apparatus 88 can also include curved track members 100, 102. The curved track members 100, 102 can be releasably engageable with the track 90. The curved track members 100, 102 can define slots that can receive part of the cart 96 and guiding the cart 96 in movement along the curved track members 100, 102. The cart 96 can be removed from the slot 98 and placed in one of the slots of the curved track members 100, 102. The user can switch from straight movement along the track 98 to arcuate movement with one of the curved track members 100, 102.

The apparatus 88 can also include a t-section 104 releasably engageable with a second end of the track 90. The t-section 104 can include curved handles 106, 108 for use while doing push-ups.

The apparatus 88 can also include a carbineer section 101 releasably engageable with the second end of the track 90. The carbineer section 101 can include a carbineer 103 for use while doing pull exercises with an elastic elongate member 105.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. An abdominal exercise apparatus comprising:

a track extending a length between a first end and a second end;

at least one rolling member rectilinearly moveable along said track between said first end and said second end by a user during exercise;

a cart supporting said at least one rolling member for the rectilinear and rolling movement along said track and said cart having a portion configured to be grasped by the user during exercise;

a base engaged with said track proximate to said first end of said track and having at least one surface configured to receive first and second knees of the user during exercise, wherein said second end of said track is pivotally movable about said base over an arcuate range by the user while exercising during the rectilinear and rolling movement along said track by said at least one rolling member; and means for resisting pivotal movement that is elastically deformable during movement over said arcuate range.

2. The abdominal exercise apparatus of claim 1 wherein said means for resisting pivotal movement is further defined as integrally-formed with one of said track and said base.

3. The abdominal exercise apparatus of claim 2 wherein said means for resisting pivotal movement is further defined as a portion of a variable cross-section of said track.

4. The abdominal exercise apparatus of claim 3 wherein said portion of variable cross-section of said track is further defined as a bellows.

5. The abdominal exercise apparatus of claim 4 further comprising:

a sleeve shaped to surround at least part of said portion of variable cross-section of said track, said sleeve slidable along said length to overlap a selectable amount of said at least part of said portion of variable cross-section of said track.

6. The abdominal exercise apparatus of claim 2 wherein said means for resisting pivotal movement is further defined as at least one rod.

7. The abdominal exercise apparatus of claim 1 further comprising:

a hinge assembly having a hinge pin and interconnecting said track and said base, wherein said means for resisting pivotal movement is further defined as structurally disposed between said track and said base in parallel to said hinge assembly.

8. The abdominal exercise apparatus of claim 7 wherein said means for resisting pivotal movement is further defined as comprising at least one torsion spring encircling said hinge pin.

9. The abdominal exercise apparatus of claim 8 wherein said at least one torsion spring is further defined as a plurality of torsion springs, each of said plurality of torsion springs individually positionable about said hinge pin and replaceable with each of the other of said plurality of torsion springs.

10. The abdominal exercise apparatus of claim 7 wherein said means for resisting pivotal movement is further defined as at least one rod.

11. The abdominal exercise apparatus of claim 10 wherein said at least one rod is further defined as a plurality of rods, said plurality of rods engageable with said track and said base individually and in groups of two or more.

12. The abdominal exercise apparatus of claim 1 wherein said base further comprises:

a rail engageable with said means for resisting pivotal movement; and a second cart mounted on said rail and defining said at least one surface configured to receive the first and second knees of the user during exercise.

13. The abdominal exercise apparatus of claim 12 wherein said base further comprises:

a third cart mounted on said rail and defining at least one surface configured to receive feet of the user during exercise.

14. The abdominal exercise apparatus of claim 13 further comprising:

at least one castor positioned on an underside of said third cart and supporting said third cart during movement along said rail.

15. The abdominal exercise apparatus of claim 13 wherein both of said second cart and said third cart are selectively and individually lockable at a plurality of different positions along said rail.

16. The abdominal exercise apparatus of claim 12 further comprising:

at least one castor positioned on an underside of said second cart and supporting said second cart during movement along said rail.

17. The abdominal exercise apparatus of claim 12 wherein said second cart is selectively lockable at a plurality of different positions along said rail.

18. The abdominal exercise apparatus of claim 1 wherein said means for resisting pivotal movement is further defined as the interconnection between said track and said base that limits movement between said track and said base.

19. The abdominal exercise apparatus of claim 18 wherein said means for resisting pivotal movement is further defined as comprising at least one helical spring.

20. The abdominal exercise apparatus of claim 19 wherein said at least one helical spring further comprises a plurality of helical springs, each of said plurality of helical springs is individually and selectively engageable with both of said track and said base and replaceable with each other.

21. The abdominal exercise apparatus of claim 1 further comprising:

at least one first castor positioned on an underside of said track and supporting said track during movement over said arcuate range.

22. The abdominal exercise apparatus of claim 21 further comprising:

at least one second castor positioned on an underside of said cart and supporting said cart during movement as said track moves over said arcuate range.

23. The abdominal exercise apparatus of claim 22 further comprising:

at least one third castor positioned on an underside of said base, whereby all of said track and said cart and said base are respectively supported from the respective undersides by said at least one first castor and said at least one second castor and said at least one third castor.

24. The abdominal exercise apparatus of claim 1 wherein said means for resisting pivotal movement further comprises:

a spring extending between a first end and a second end;

a first plate positioned at said first end of said spring; and a second plate positioned at said second end of said spring.

25. The abdominal exercise apparatus of claim 24 wherein:

said track further comprises a first pocket and said first plate is selectively receivable in said first pocket; and said base further comprises a second pocket and said second plate is selectively receivable in said second pocket.

26. The abdominal exercise apparatus of claim 1 wherein said means for resisting pivotal movement is further defined as selectively variable.

27. The abdominal exercise apparatus of claim 1 wherein said track and said base are releasably connected through said means for resisting pivotal movement.

28. The abdominal exercise apparatus of claim 1 wherein said means for resisting pivotal movement is the only structural interconnection between said track and said base.

29. The abdominal exercise apparatus of claim 1 further comprising:

at least one castor positioned on an underside of said cart and supporting said cart during movement as said track moves over said arcuate range.

30. The abdominal exercise apparatus of claim 1 wherein said portion of said cart configured to be grasped by the user during exercise is further defined as:

first and second handles disposed on opposite sides of said cart.

31. The abdominal exercise apparatus of claim 1 wherein said means for resisting pivotal movement is further defined a torsional spring having a resistance to bending that varies over an extent of deformation.

32. The abdominal exercise apparatus of claim 1 wherein said track and said base are integrally formed.

33. The abdominal exercise apparatus of claim 1 wherein said track has an outer surface that is cylindrical over a majority of said length.

34. The abdominal exercise apparatus of claim 1 wherein said at least one rolling member is further defined as a plurality of roller members each having a rolling axis about which the respective rolling movement occurs and wherein at least two said rolling axes are transverse to one another.

* * * * *